US007049752B2

(12) United States Patent
Tani et al.

(10) Patent No.: US 7,049,752 B2
(45) Date of Patent: May 23, 2006

(54) LIGHT EMITTING DIODE CONTROL DEVICE

(75) Inventors: Shinji Tani, Nishio (JP); Yoshichika Abe, Anjo (JP)

(73) Assignees: Anden Co., Ltd., Anjo (JP); Denso Corporation, Kariya (JP)

( * ) Notice: Subject to any disclaimer, the term of this patent is extended or adjusted under 35 U.S.C. 154(b) by 86 days.

(21) Appl. No.: 10/760,486

(22) Filed: Jan. 21, 2004

(65) Prior Publication Data

US 2004/0150355 A1 Aug. 5, 2004

(30) Foreign Application Priority Data

Jan. 31, 2003 (JP) ..... 2003-023316

(51) Int. Cl.
*G09G 3/10* (2006.01)

(52) U.S. Cl. ..... 315/169.1; 315/291; 315/169.3; 315/312; 340/475; 340/825.63; 340/825.64

(58) Field of Classification Search ..... 315/77, 315/82, 83, 169.1, 169.3, 291, 200 A, 209 R, 315/312, 315; 340/475, 477, 825.63, 825.64; 345/46, 82, 77, 212; 307/10.1, 10.8
See application file for complete search history.

(56) References Cited

U.S. PATENT DOCUMENTS

| | | | | |
|---|---|---|---|---|
| 4,438,425 | A * | 3/1984 | Tsuchida et al. | 307/10.1 |
| 5,929,568 | A | 7/1999 | Eggers | 315/56 |
| 6,628,252 | B1 * | 9/2003 | Hoshino et al. | 345/82 |
| 6,661,428 | B1 * | 12/2003 | Kim | 345/690 |
| 6,700,692 | B1 * | 3/2004 | Tonar et al. | 359/265 |
| 6,724,376 | B1 * | 4/2004 | Sakura et al. | 345/204 |
| 6,844,760 | B1 * | 1/2005 | Koharagi et al. | 327/110 |

FOREIGN PATENT DOCUMENTS

JP A-2001-244087 9/2001

* cited by examiner

*Primary Examiner*—Haissa Philogene
(74) *Attorney, Agent, or Firm*—Posz Law Group, PLC

(57) ABSTRACT

A control device of LEDs includes a lighting-up circuit and a lighting-out circuit, both of which generate pulse signals being pulse-width modulated by varying cycles and corresponding duty ratios based on an input signal during a start-up period and a falling period, respectively. The control device then provides LEDs with the electric current relative to the pulse signals. Both of the lighting-up circuit and lighting-out circuit vary the cycles and corresponding duty ratios of the pulse signals, so that a luminance variation characteristic of the LEDs becomes nonlinear, leading to being approximated to a luminance variation characteristic of an electric bulb.

5 Claims, 9 Drawing Sheets

LIGHT EMITTING DIODE CONTROL DEVICE

CROSS REFERENCE TO RELATED APPLICATIONS

This application is based on and incorporates herein by reference Japanese Patent Application No. 2003-23316 filed on Jan. 31, 2003.

FIELD OF THE INVENTION

The present invention relates to a control device of light emitting diodes that is suited for use in a turning signal lamp of a vehicle.

BACKGROUND OF THE INVENTION

Recently, LEDs (Light Emitting Diodes) that need little electricity have been examined in use for a turning signal lamp of a vehicle instead of an electric bulb.

With respect to the electric bulb used in the turning signal lamp, as electric current starts flowing through a filament of the bulb, an electric bulb increases its luminance with increasing filament temperature, as shown in FIG. 7. As electric current conversely stops flowing through the filament of the bulb, the electric bulb decreases its luminance with decreasing filament temperature, as shown in FIG. 8. The electric bulb has thus a nonlinear characteristic of luminance variation. Further, a start-up period (or lighting-up period) during which luminance of the bulb becomes stable is approximately 300 ms, while a falling period (or lighting-out period) during which luminance of the bulb becomes zero is approximately 100 ms. Luminous intensity of the turning signal lamp using the electric bulb thereby varies with a slow response characteristic.

In contrast, with respect to LEDs, both start-up period and falling period are not more than 1 μs. Luminous intensity of the turning signal lamp using the LEDs thereby varies with a quick response characteristic.

Therefore, it has been proposed that a control circuit of LEDs has a slow luminance variation during its lighting-up period or lighting-out period (See JP-2001-244087A). Here, the luminance of the LEDs is gradually varied by varying a duty ratio of electric current flowing through the LEDs during the light-up and light-out periods.

In this control circuit, when the duty ratio is linearly increased during a lighting-up period, luminance of LEDs linearly increases, as shown in FIG. 9. When the duty ratio is conversely linearly decreased during a lighting-out period, the luminance of LEDs linearly decreases, as shown in FIG. 10. Linear varying of the duty ratio thus leads to gradual variation in a luminance characteristic of the LEDs. However, this luminance variation characteristic of the LEDs differs from that of the electric bulb, results in offering feeling of strangeness to a user.

SUMMARY OF THE INVENTION

It is an object of the present invention to provide a control device of LEDs capable of nonlinearly varying a luminance variation characteristic of LEDs during a star-up period or a falling period.

To achieve the above object, a control device driving LEDs is provided with driving means and pulse output means. Here, the pulse output means varies, of a pulse signal outputted to the driving means, a cycle and a corresponding duty ratio, to control the driving means.

This structure enables a luminance variation characteristic of LEDs to become nonlinear since a cycle and a corresponding duty ratio of the pulse signal can be varied for driving the LEDs as intended.

BRIEF DESCRIPTION OF THE DRAWINGS

The above and other objects, features, and advantages of the present invention will become more apparent from the following detailed description made with reference to the accompanying drawings. In the drawings.

DETAILED DESCRIPTION OF THE PREFERRED EMBODIMENTS (First Embodiment)

Figure 1:
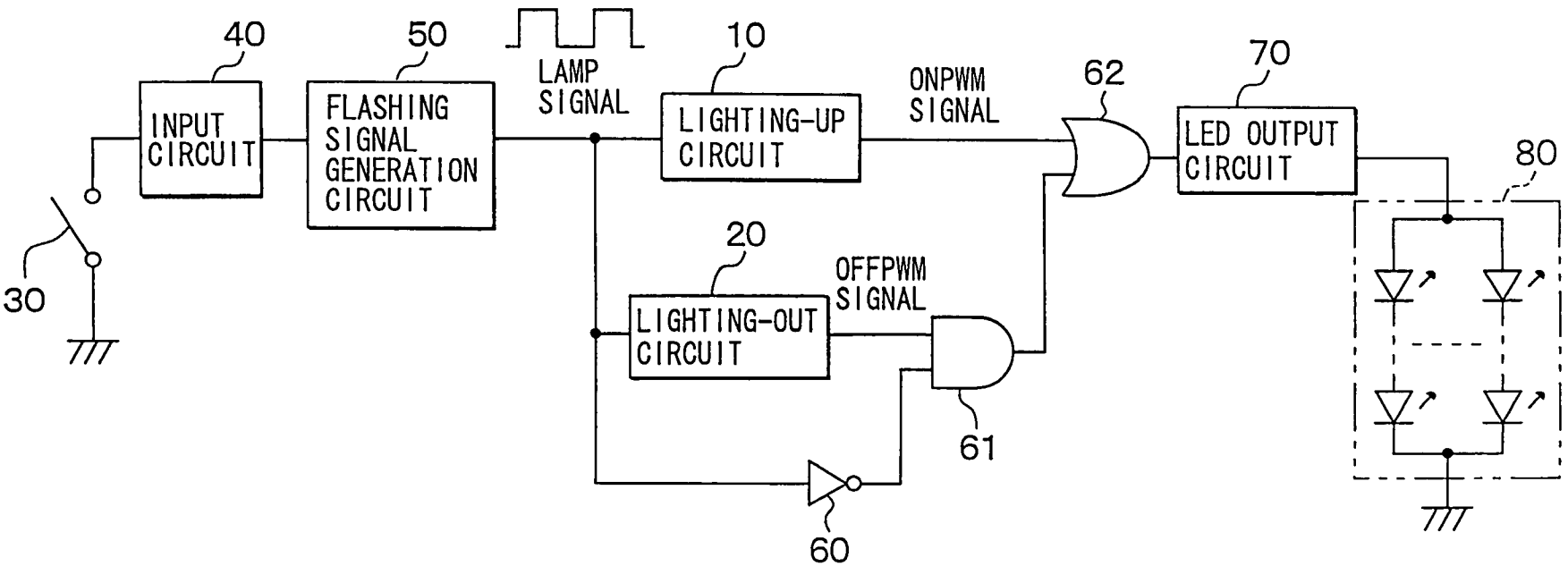
FIG. 1 is a block diagram showing an overall structure of a control device of LEDs according to a first embodiment of the present invention.

A first embodiment of the present invention is directed to a control device of LEDs (Light Emitting Diodes) connected with LEDs that are used in a turning signal lamp of a vehicle. FIG. 1 shows an overall structure of the control device of LEDs including the LEDs. The control device includes: an input circuit 40; a flashing signal generation circuit 50; a lighting-up circuit 10; a lighting-out circuit 20; an inverter circuit 60; an AND circuit 61; an OR circuit 62; and an LED output circuit 70.

The input circuit 40 is connected with a turning signal lamp switch 30 to output a signal relative to operation of the turning signal lamp switch 30. The flashing signal generation circuit 50 outputs, according to the signal from the input circuit 40, a lamp signal that repeats ON/OFF to blink the LEDs 80 for use in the turning signal lamp. The lighting-up circuit 10 outputs a pulse-width modulated (PWM) ONPWM signal to gradually vary a cycle and a corresponding duty ratio when the signal from the flashing signal generation circuit 50 is switched from OFF to ON. The lighting-out circuit 20 outputs a pulse-width modulated (PWM) OFFPWM signal to gradually vary a cycle and a corresponding duty ratio when the signal from the flashing signal generation circuit 50 is switched from ON to OFF.

The OR circuit 62 outputs to the LED output circuit 70 either the ONPWM signal from the lighting-up circuit 10 or the OFFPWM signal from the lighting-out circuit 20. The inverter circuit 60 and AND circuit 61 are disposed for preventing the lighting-out circuit 20 from outputting the OFFPWM signal to the OR circuit 62 when the lamp signal is being ON. The LED output circuit 70 is connected with the LEDs 80 disposed at a corner of the vehicle for use in the turning signal lamp of the vehicle and supplies the LEDs 80 with electric power based on the output of the OR circuit 62.

Figure 2:
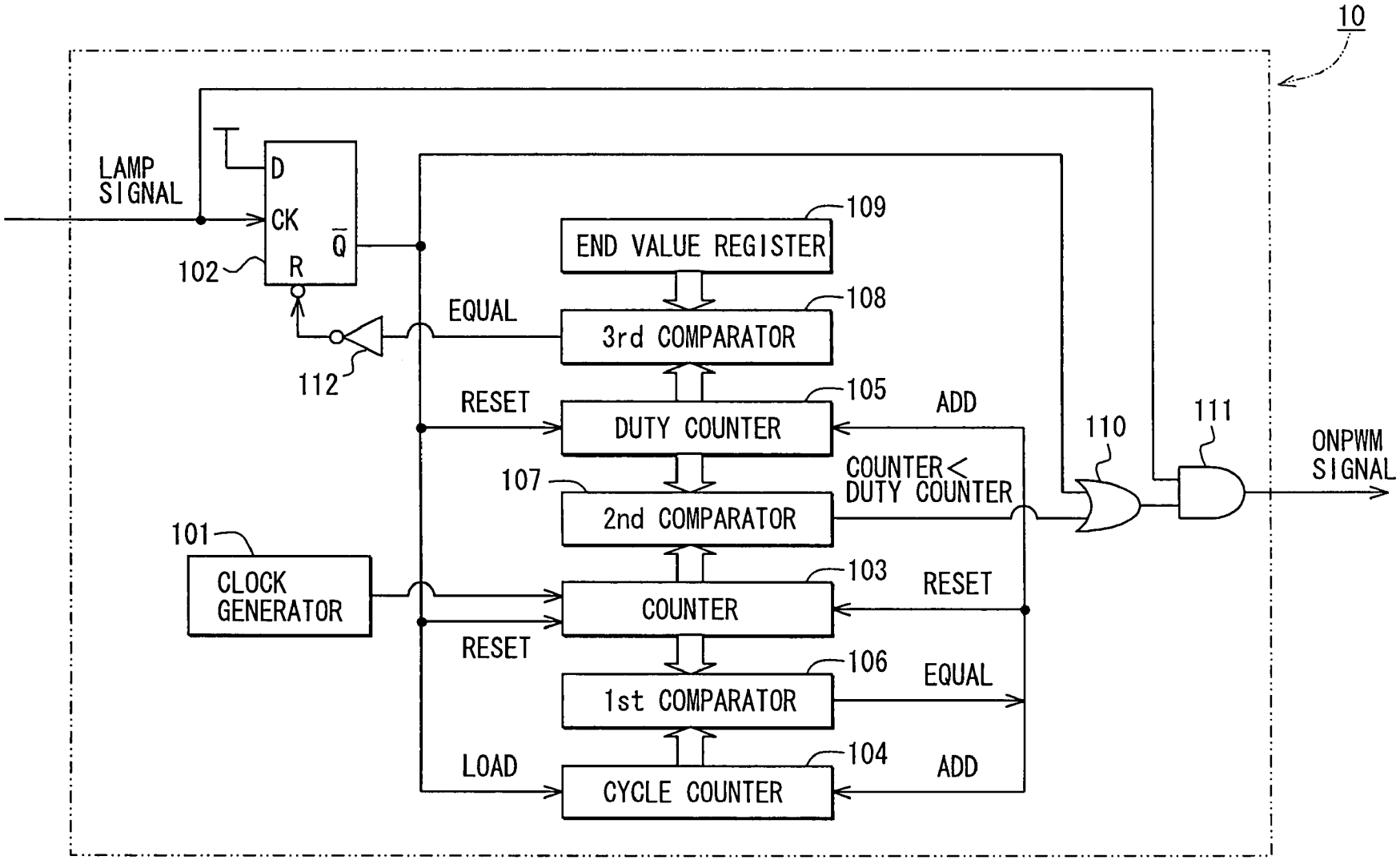
FIG. 2 is a block diagram of a lighting-up circuit of the control device according to the first embodiment.

FIG. 2 shows a structure of the lighting-up circuit 10. The lighting-up circuit 10 includes: a clock generator 101; a flip-flop 102; a counter 103; a cycle counter 104; a duty counter 105; a first comparator 106; a second comparator 107; a third comparator 108; an end value register 109; an OR circuit 110; an AND circuit 111; and an inverter circuit 112.

The flip-flop 102 outputs a low-level signal from an output terminal Q bar when the lamp signal inputted from the flashing signal generation circuit 50 is switched from OFF to ON, while it outputs a high-level signal when it is reset due to a signal from the third comparator 108. The clock generator 101 outputs a clock signal having a given frequency. The counter 103 is synchronized with the clock signal inputted from the clock generator 101 to count up and is reset due to either a high-level signal from the output terminal Q bar of the flip-flop 102 or a high-level output signal from the first comparator 106. The cycle counter 104 is loaded with "8" as an initial value due to the high-level signal from the output terminal Q bar and then adds "1" to its counter value based on the high-level output signal from the first comparator 106. The duty counter 105 adds "2" to its counter value based on the high-level output signal from the first comparator 106 and is reset due to the high-level signal from the output terminal Q bar.

The first comparator 106 compares the counter values of the counter 103 and cycle counter 104 to output a high-level signal when both the counter values are equal. Due to this high-level signal, the duty counter 105 adds "2" to its counter value, the cycle counter 104 adds "1" to its counter value, and the counter 103 is reset. The end value register 109 is previously stored with "16" as a value terminating counting of the duty counter 105. The third comparator 108 compares the counter value of the duty counter 105 with the value set in the end value register 109. When the counter value and the set value are equal, the third comparator 108 outputs a reset signal for resetting the flip-flop 102.

The second comparator 107 compares the counter values of the counter 103 and duty counter 105 and outputs a high-level signal when the counter value of the counter 103 is less than that of the duty counter 105. The output signal of the second comparator 107 is outputted as the ONPWM signal from an output terminal of the AND circuit 111 via the OR circuit 110 and AND circuit 111.

Figure 3:
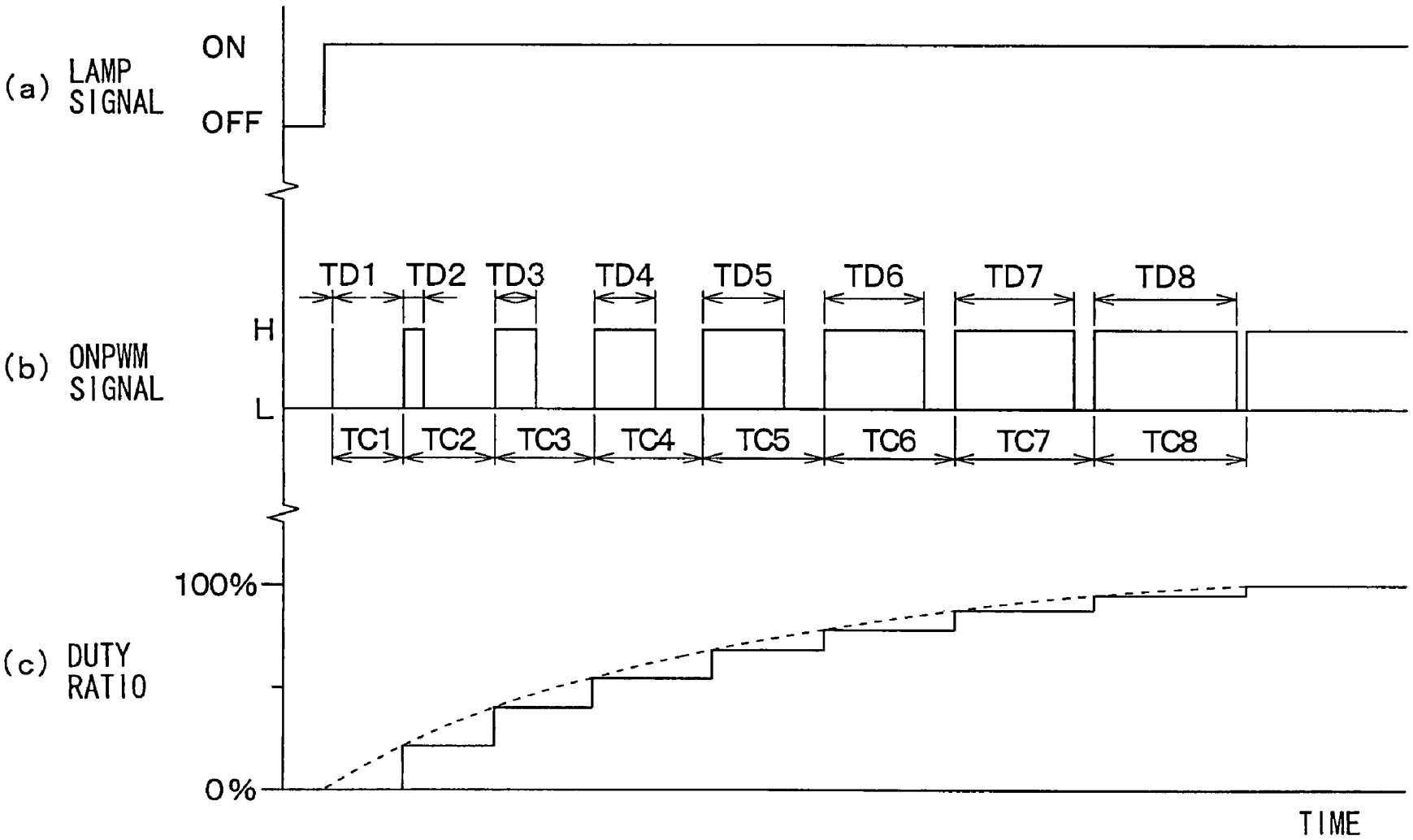
FIG. 3 is a time chart diagram showing a variation characteristic during a lighting-up period in the lighting-up circuit of the control device according to the first embodiment.

Next, an operation of the lighting-up circuit 10 will be explained with reference to FIG. 3. FIG. 3 is a time chart diagram of the lamp signal, the ONPWM signal, and a variation characteristic of duty ratio of the ONPWM signal during a start-up period (or lighting-up period).

At first, suppose that a lamp signal of OFF is being inputted to the flip-flop 102 and the flip-flop 102 is reset as shown in FIG. 3(*a*). In this state, a high-level signal is being outputted from the output terminal Q bar of the flip-flop 102. The counter values of the duty counter 105 and the counter 103 are reset to "0." The cycle counter 104 is loaded with "8" as a counter value. Here, a lamp signal of OFF is being input to the AND circuit 111, so that the ONPWM signal remains low-level.

Next, as the lamp signal is switched from OFF to ON as shown in FIG. 3(*a*), the output terminal Q bar of the flip-flop 102 represents low-level. The counter 103 starts counting up by being synchronized with a clock inputted from the clock generator 101. The first comparator 106 compares the counter values of the counter 103 and the cycle counter 104. When the values are equal, i.e., both the counter values are "8," the first comparator 106 outputs a high-level signal. Due to this high-level output signal, the counter value of the cycle counter 104 increases by "1," that of the duty counter 105 increases by "2", and the counter 103 is reset. Namely, the counter value of the cycle counter 104 becomes "9," the counter value of the duty counter 105 becomes "2," and the counter value of the counter 103 becomes "0."

For a period where the counter value of the counter 103 shifts from "0" to "8," i.e., period TC1 in FIG. 3(*b*), the counter value of the duty counter 105 is "0." The counter value of the counter 103 is thereby not less than that of the duty counter 105, so that the output of the second comparator 107 remains low-level. This output of the second comparator 107 is outputted from the AND circuit 111. Here, the duty ratio of the ONPWM signal is TD1/TC1 (=0/8).

Next, the counter 103 resumes counting up the counter value from "0." As the counter value of the counter 103 reaches "9," it equals the counter value of the cycle counter 104. The first comparator 106 thereby outputs a high-level signal. Due to this high-level output signal, the counter value of the cycle counter 104 increases by "1," that of the duty counter 105 increases by "2," and the counter 103 is reset. Namely, the counter value of the cycle counter 104 becomes "10," the counter value of the duty counter 105 becomes "4," and the counter value of the counter 103 becomes "0."

For a period where the counter value of the counter 103 shifts from "0" to "9," i.e., period TC2 in FIG. 3(*b*), the counter value of the duty counter 105 is "2." While the counter value of the counter 103 is "0" and "1," the output of the second comparator 107 thereby becomes high-level. Here, the duty ratio of the ONPWM signal is TD2/TC2 (=2/9).

Further, the counter 103 resumes counting up the counter value from "0." As the counter value of the counter 103 reaches "10," the first comparator 106 thereby outputs a high-level signal. Due to this high-level output signal, the counter value of the cycle counter 104 increases by "1," that of the duty counter 105 increases by "2", and the counter 103 is reset. Namely, the counter value of the cycle counter 104 becomes "11," the counter value of the duty counter 105 becomes "6," and the counter value of the counter 103 becomes "0."

For a period where the counter value of the counter 103 shifts from "0" to "10," i.e., period TC3 in FIG. 3(*b*), the counter value of the duty counter 105 is "4." While the counter value of the counter 103 is "0" to "3," the output of the second comparator 107 thereby becomes high-level. Here, the duty ratio of the ONPWM signal is TD3/TC3 (=4/10).

Similarly, each time the counter value of the counter 103 equals that of the cycle counter 104, the first comparator 106 outputs a high-level signal. Due to this high-level output signal, the counter value of the cycle counter 104 increases by "1," that of the duty counter 105 increases by "2," and the counter 103 is reset. Therefore, the duty ratio of the ONPWM signal becomes 6/11, 8/11, 10/13, 12/14, and 14/15 for periods TC4 to TC8 shown in FIG. 3(*b*), respectively.

As the counter value of the duty counter 105 reaches "16" of the set value of the end value register 109, the third comparator 108 outputs a reset signal to cause the flip-flop 102 to be reset. The output terminal Q bar of the flip-flop 102 then becomes high-level, so that the output of the OR circuit 110 becomes high-level and the duty ratio of the ONPWM signal becomes 100%.

As the lamp signal is switched from OFF to ON, the duty ratio of the ONPWM signal thus becomes nonlinear as shown in a dotted line in FIG. 3(*c*). This is approximated to a luminance variation characteristic of the electric bulb during a lighting-up period.

Furthermore, when the counter value of the duty counter 105 equals "16" of the set value of the end value register 109, the counter 103 is reset due to the high-level signal of the output terminal Q bar of the flip-flop 102, leading to stopping of the above-mentioned counting procedure.

Figure 4:
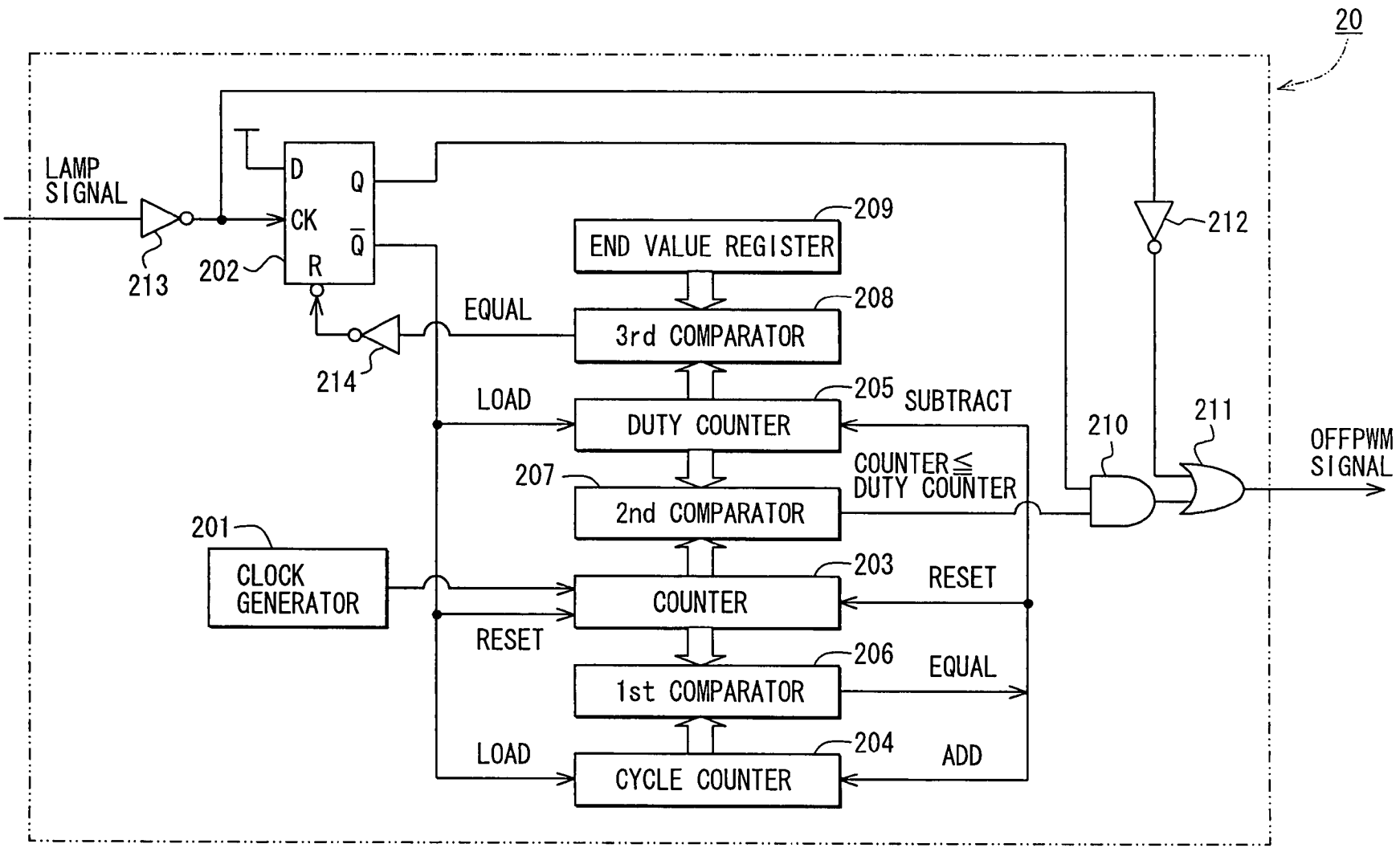
FIG. 4 is a block diagram of a lighting-out circuit of the control device according to the first embodiment.

In the next place, the lighting-out circuit 20 will be explained below. FIG. 4 shows a structure of the lighting-out circuit 20. This structure is similar with that of the lighting-up circuit 10, enabling the duty ratio gradually to decrease based on the OFFPWM signal when the lamp signal is switched from ON to OFF.

The lighting-out circuit 20 includes: a clock generator 201; a flip-flop 202; a counter 203; a cycle counter 204; a duty counter 205; a first comparator 206; a second comparator 207; a third comparator 208; an end value register 209; an AND circuit 210; an OR circuit 211; and inverter circuits 212 to 214.

The flip-flop 202 outputs a high-level signal from an output terminal Q and a low-level signal from an output terminal Q bar when the lamp signal inputted from the flashing signal generation circuit 50 is switched from ON to OFF. The flip-flop 202 further outputs a low-level signal from the output terminal Q and a high-level signal from the output terminal Q bar when it is reset due to a reset signal from the third comparator 208.

The duty counter 205 subtracts "1" from a counter value based on the high-level output signal from the first comparator 206 and is loaded with "8" as an initial value due to the high-level signal from the output terminal Q bar of the flip-flop 202.

The end value register 209 is previously stored with "0" as a value terminating counting of the duty counter 205.

The second comparator 207 compares the counter values of the counter 203 and duty counter 205 and outputs a high-level signal when the counter value of the counter 203 is not more than that of the duty counter 205. The output signal of the second comparator 207 is outputted as an OFFPWM signal from an output terminal of the OR circuit 211 via the AND circuit 210 and the OR circuit 211.

Figure 5:
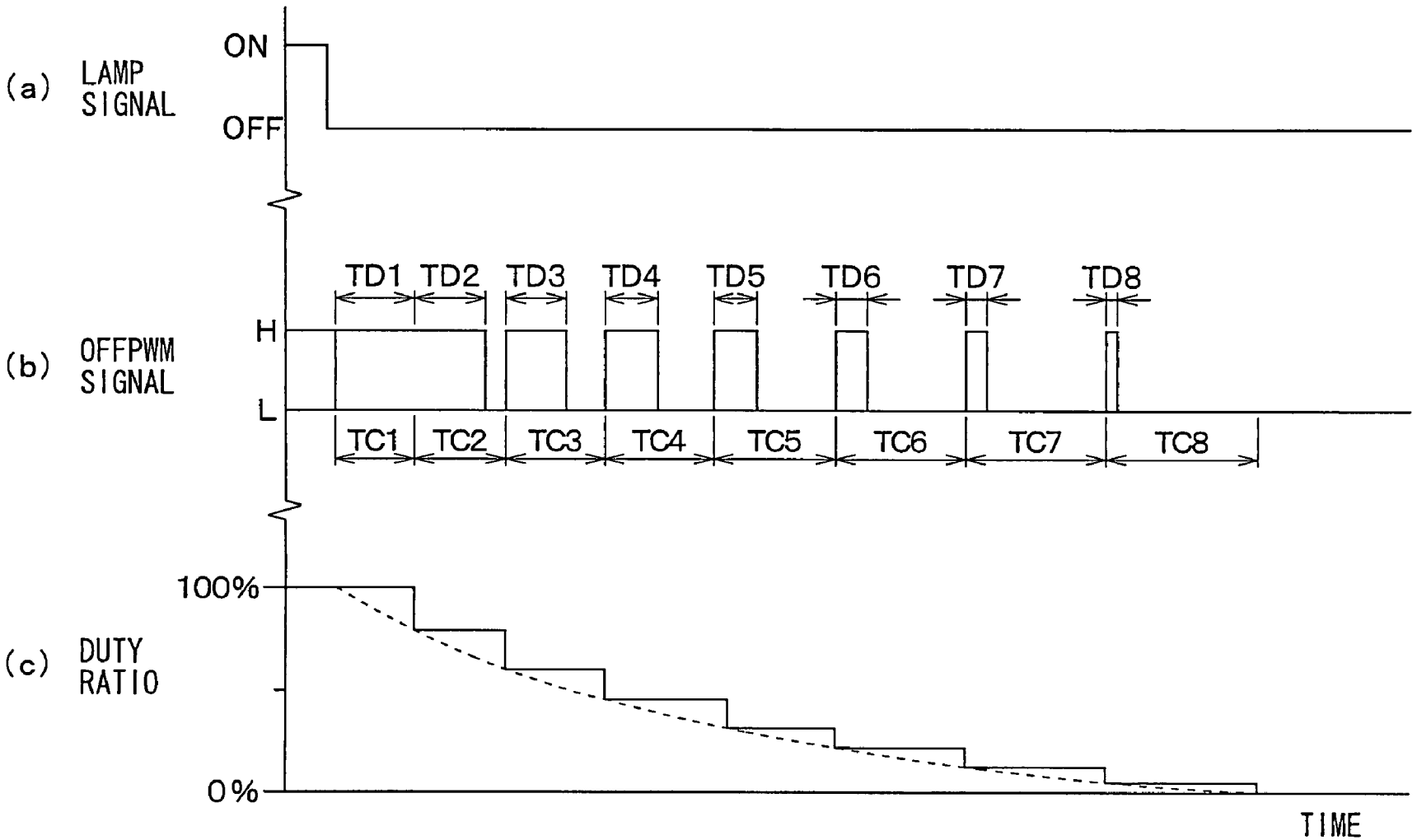
FIG. 5 is a time chart diagram showing a variation characteristic during a lighting-out period in the lighting-out circuit of the control device according to the first embodiment.

Next, an operation of the lighting-out circuit 20 will be explained with reference to FIG. 5. FIG. 5 is a time chart diagram of the lamp signal, the OFFPWM signal, and a variation characteristic of duty ratio of the OFFPWM signal during a falling period (or a light-out period).

At first, suppose that a lamp signal of ON is being inputted to the flip-flop 202 and the flip-flop 202 is reset as shown in FIG. 5(*a*). In this state, a high-level signal is being outputted from the output terminal Q bar of the flip-flop 202. The counter value of the counter 103 is reset to "0." The cycle counter 204 and duty counter 205 are loaded with "8", as initial counter values. Here, the lamp signal is being inputted to the OR circuit 211 via the inverter circuits 213, 212, so that a high-level OFFPWM signal is outputted from the output terminal of the OR circuit 211.

Next, as the lamp signal is switched from ON to OFF as shown in FIG. 5(*a*), the output terminal Q bar of the flip-flop 202 represents low-level. The counter 203 starts counting up by being synchronized with a clock inputted from the clock generator 201. The first comparator 206 compares the values of the counter 203 and the cycle counter 204. When the values are equal, i.e., the counter value of the counter 203 becomes "8," the first comparator 206 outputs a high-level signal. Due to this high-level output signal, the counter value of the cycle counter 204 increases by "1," that of the duty counter 105 decreases by "1," and the counter 203 is reset. Namely, the counter value of the cycle counter 204 becomes "9," the counter value of the duty counter 205 becomes "7," and the counter value of the counter 203 becomes "0."

For a period where the counter value of the counter 203 shifts till "8," i.e., period TC1 in FIG. 5(*b*), the counter value of the duty counter 205 is "8." The counter value of the counter 203 is thereby not more than that of the duty counter 205, so that the output of the second comparator 207 remains high-level. This output of the second comparator 207 is inputted to the AND circuit 210. This then causes the OR circuit 211 to output an OFFPWM signal. Here, the duty ratio of the OFFPWM signal is TD1/TC1 (=8/8).

Next, the counter 203 resumes counting up the counter value from "0." As the counter value of the counter 203 reaches "9," it equals the counter value of the cycle counter 204. The first comparator 206 thereby outputs a high-level signal. Due to this high-level output signal, the counter value of the cycle counter 204 increases by "1," that of the duty counter 205 decreases by "1," and the counter 203 is reset. Namely, the counter value of the cycle counter 204 becomes "2," the counter value of the duty counter 205 becomes "7," and the counter value of the counter 203 becomes "0."

For a period where the counter value of the counter 203 shifts from "0" to "9," i.e., period TC2 in FIG. 5(*b*), the counter value of the duty counter 205 is "8." While the counter value of the counter 203 is "0" to "8," the output of the second comparator 207 becomes high-level. By contrast, while the counter value of the counter 203 is "9," the output of the second comparator 207 becomes low-level. Here, the duty ratio of the OFFPWM signal is TD2/TC2 (=7/9).

Similarly, each time the counter value of the counter 203 equals that of the cycle counter 204, the first comparator 206 outputs a high-level signal. Due to this high-level output signal, the counter value of the cycle counter 204 increases by "1," that of the duty counter 205 decreases by "1," and the counter 203 is reset. Therefore, the duty ratio of the OFFPWM signal becomes 6/10, 5/11, 4/12, 3/13, 2/14, and 1/15 for periods TC3 to TC8 shown in FIG. 5(*b*), respectively.

As the counter value of the duty counter 205 reaches "0" of the set value of the end value register 209, the third comparator 208 outputs a reset signal to cause the flip-flop 202 to be reset. The output terminal Q of the flip-flop 202 then becomes low-level, so that the output of the AND circuit 210 becomes low-level and the duty ratio of the OFFPWM signal becomes 0%.

As the lamp signal is switched from ON to OFF, the duty ratio of the OFFPWM signal thus becomes nonlinear as shown in a dotted line in FIG. 5(*c*). This is approximated to a luminance variation characteristic of the electric bulb during a lighting-out period.

Furthermore, when the counter value of the duty counter 205 equals "0" of the set value of the end value register 209, the counter 203 is reset due to the high-level signal of the output terminal Q bar of the flip-flop 202, leading to stopping of the above-mentioned counting procedure.

As explained above, when the lamp signal from the flashing signal generation circuit 50 is switched from OFF to ON, the lighting-up circuit 10 outputs the ONPWM signal that enables a cycle and a corresponding duty ratio to gradually vary as shown in FIG. 3(*b*). The LED output circuit 70 supplies the LEDs 80 with electric current having the duty ratio according to this ONPWM signal. As a result, the luminance variation characteristic of the LEDs 80 is approximated to that of the electric bulb during a lighting-up period shown in FIG. 3(*c*).

Furthermore, when the lamp signal from the flashing signal generation circuit 50 is switched from ON to OFF, the lighting-out circuit 20 outputs the OFFPWM signal that enables a cycle and a corresponding duty ratio to gradually vary as shown in FIG. 5(*b*). The LED output circuit 70 supplies the LEDs 80 with electric current having the duty ratio according to this OFFPWM signal. As a result, the luminance variation characteristic of the LEDs 80 is approximated to that of the electric bulb during a lighting-out period shown in FIG. 5(*c*).

Thus approximating a luminance variation of LEDs to that of an electric bulb cancels feeling of strangeness existing between them. This enables the LEDs to have a visually mild luminance variation characteristic, resulting in exhibiting high quality. Further, it does not seem to be digitally controlled, so that a natural luminance variation characteristic can be obtained. This leads to protection against eyestrain.

The above control device of LEDs is formed of logical circuits such as various counters and comparators. This structure eliminates necessity of a memory or the like that stores a variation characteristic of a duty ratio. For instance, it can be easily built within a single customized IC.

Figure 6:
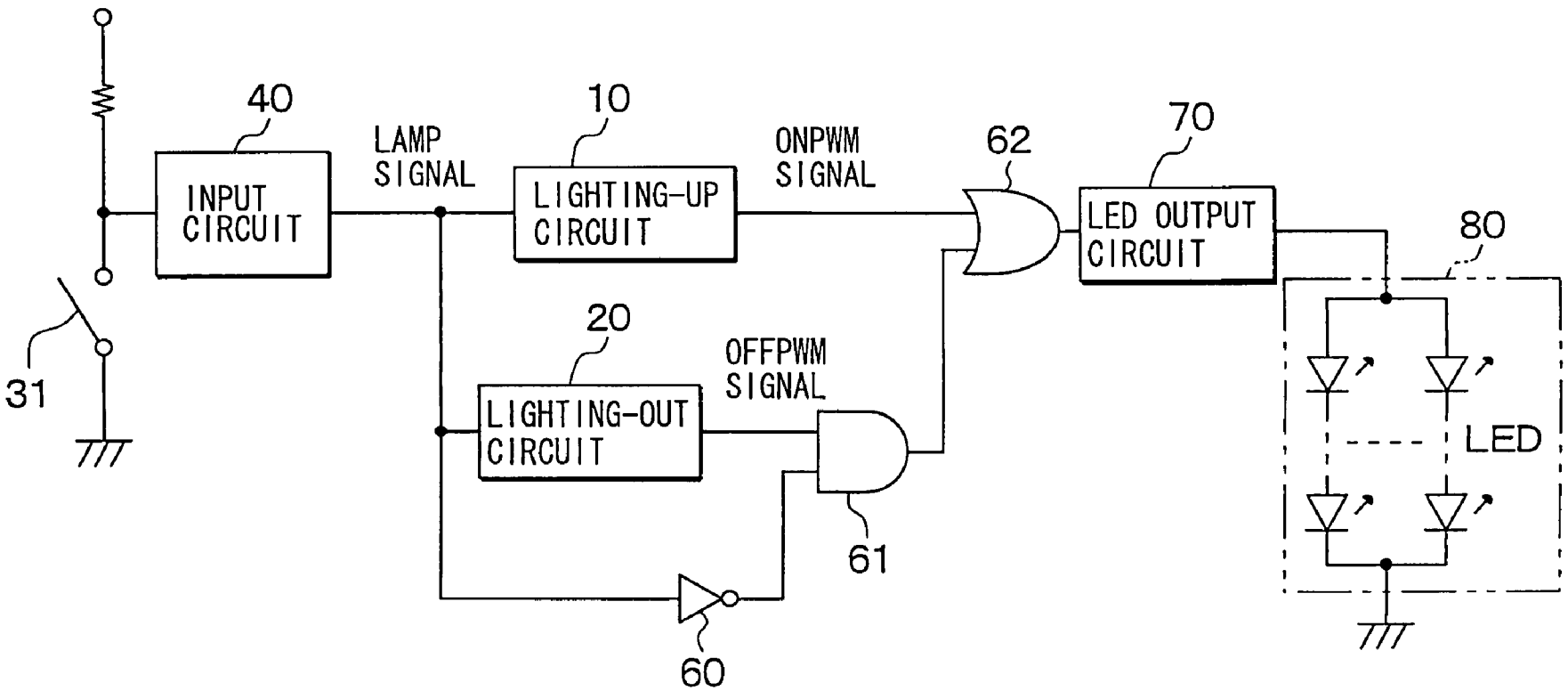
FIG. 6 is a block diagram showing an overall structure of a control device continuously lighting up LEDs.
Figure 7:
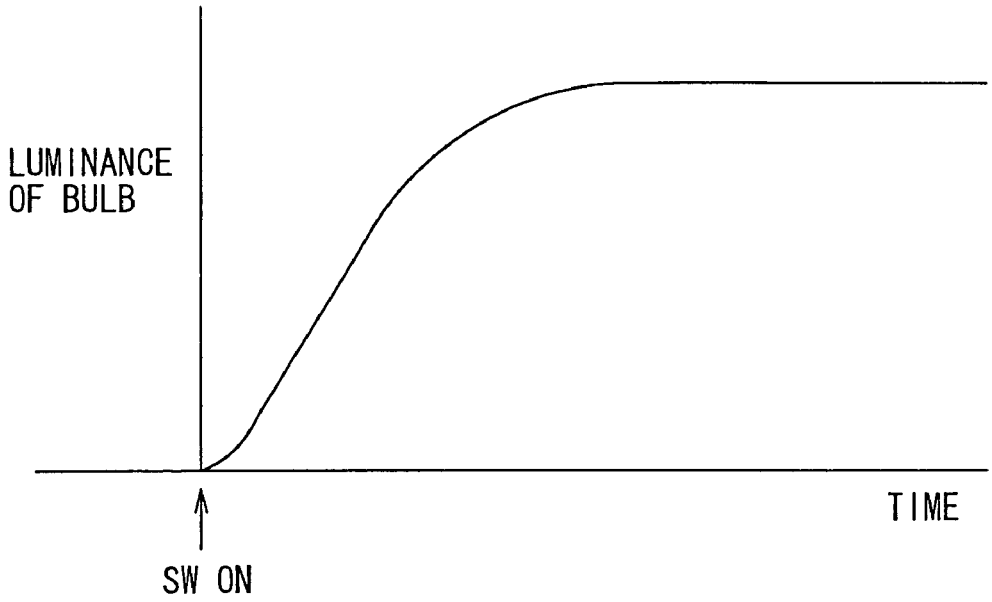
FIG. 7 RELATED ART
FIG. 7 is a graph showing luminance of a bulb during a lighting-up period.
Figure 8:
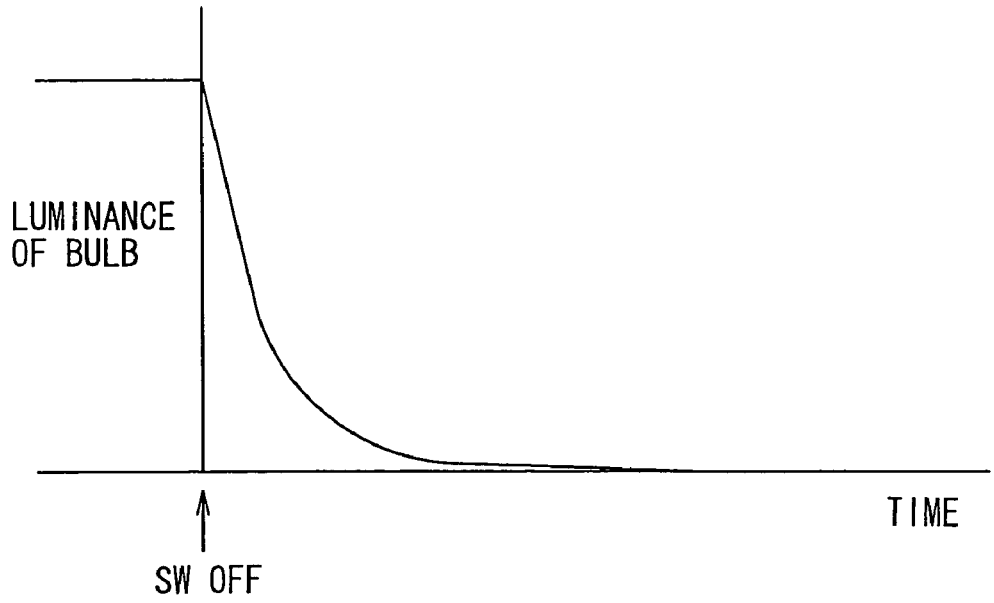
FIG. 8 RELATED ART
FIG. 8 is a graph showing luminance of a bulb during a lighting-out period.
Figure 9:
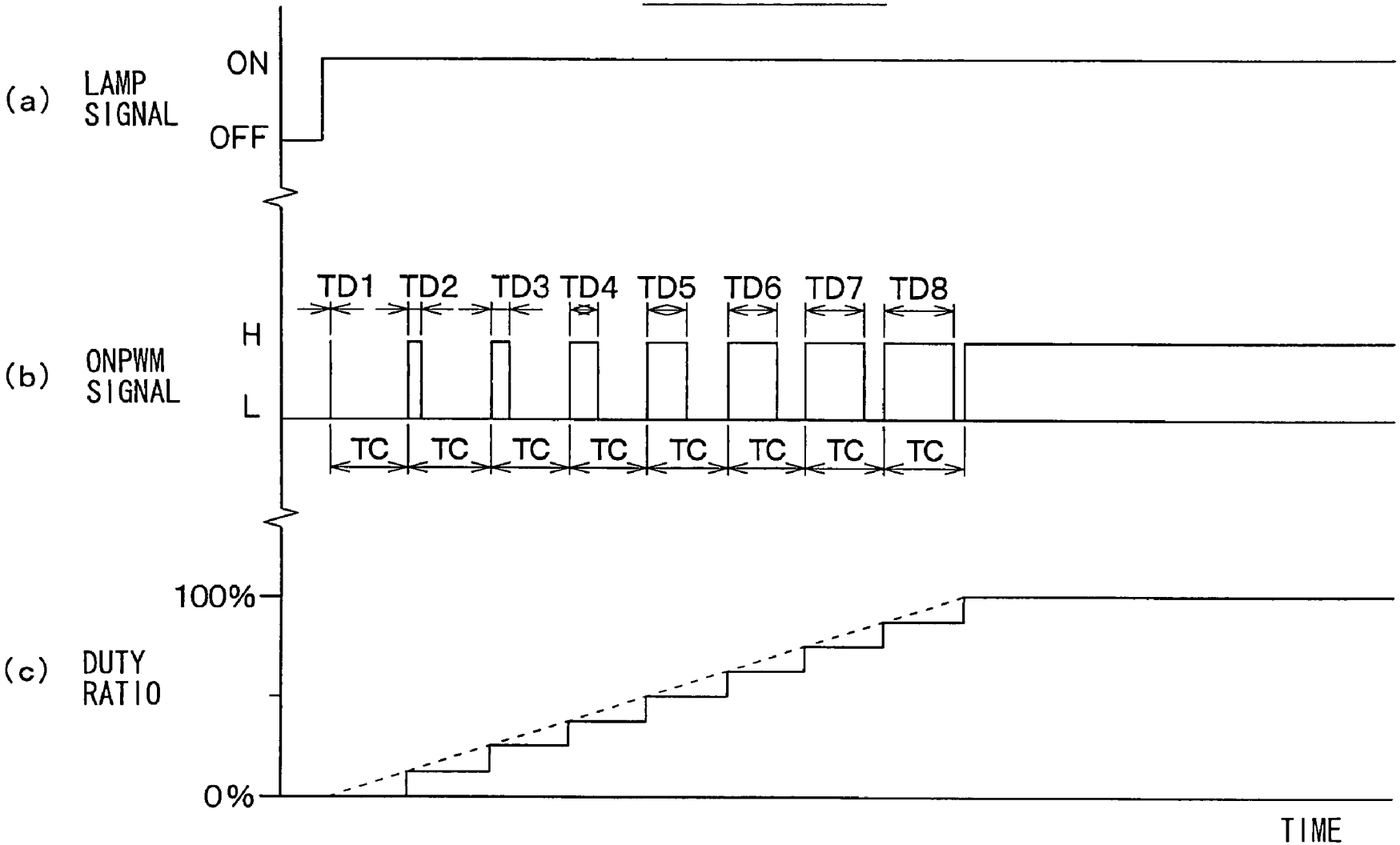
FIG. 9 RELATED ART
FIG. 9 is a time chart diagram showing a variation characteristic during a lighting-up period when a duty ratio is linearly increased in a conventional control circuit of LEDs.
Figure 10:
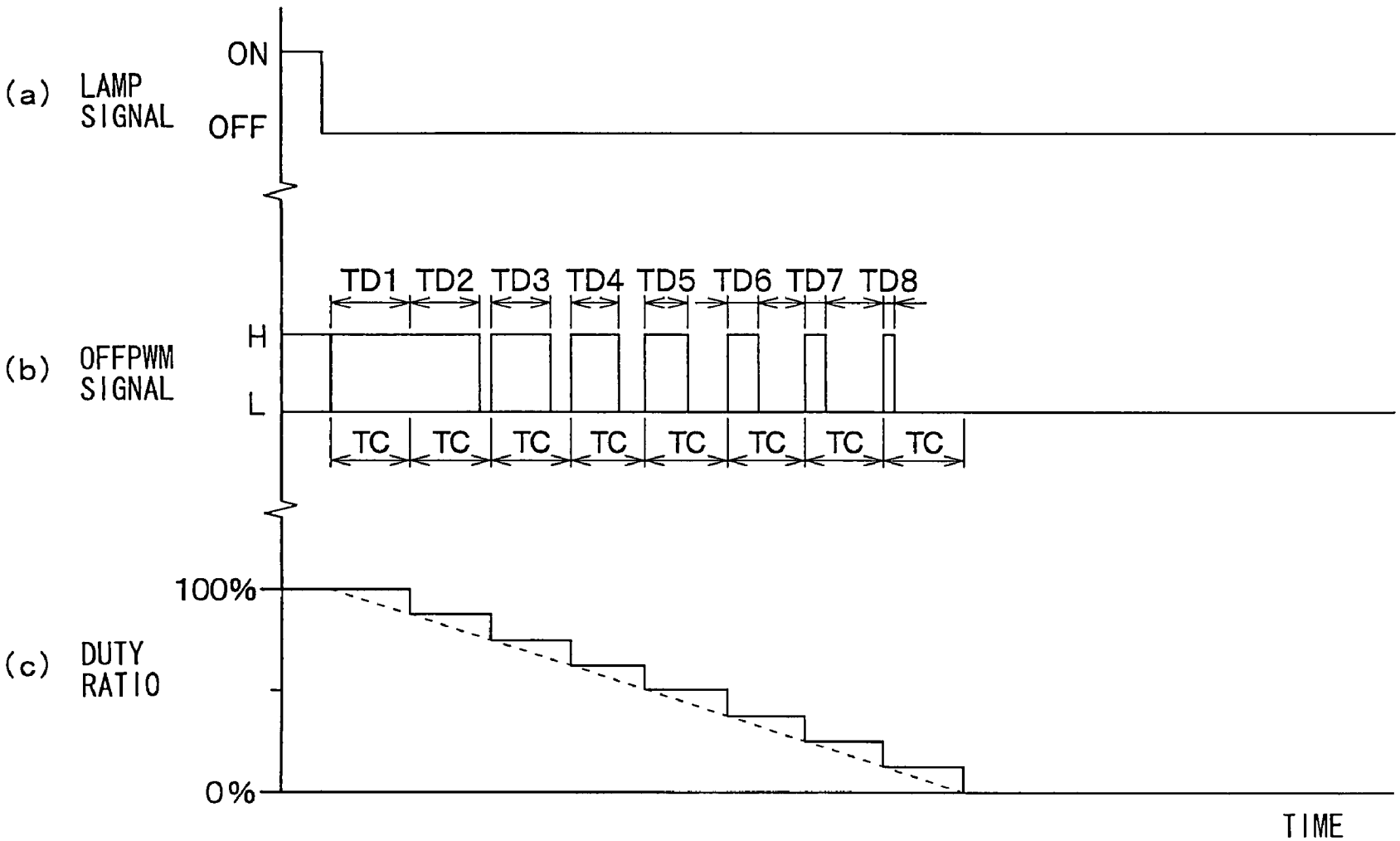
FIG. 10 RELATED ART
FIG. 10 is a time chart diagram showing a variation characteristic during a lighting-out period when a duty ratio is linearly decreased in the conventional control circuit of LEDs.

Furthermore, in the above embodiment, the LEDs are used in a turning signal lamp of a vehicle, so that a control device of the LEDs includes a flashing signal generation circuit 50 generating a lamp signal that repeats ON/OFF. However, when the LEDs are continuously lighted up, a lamp signal can be outputted from an input circuit 40 based on an operation of an ON/OFF switch 31 shown in FIG. 6.

Furthermore, the above embodiment includes, in the lighting-up or lighting-out circuits 10, 20, counter values, set values when being loaded, added or subtracted values to the counters, end values, or comparison conditions in the comparators. These values are only examples, and can be changed to enhance approximating a luminance variation characteristic to that of an electric bulb.

Furthermore, in the above embodiment, the respective circuits can be recognized as methods for achieving the respective functions, so that the respective functions in the embodiment can be also achieved by a software method using a micro-computer.

It will be obvious to those skilled in the art that various changes may be made in the above-described embodiments of the present invention. However, the scope of the present invention should be determined by the following claims.

What is claimed is:

1. A control device of LEDs, comprising:

driving means for driving LEDs; and pulse output means for varying a cycle and a corresponding duty ratio of a pulse signal outputted to the driving means to control the driving means, wherein the pulse output means includes lighting-up means that gradually increases the cycle and the corresponding duty ratio of the pulse signal during a lighting-up period of the LEDs beginning at a start of a lighting-up of the LEDs.

wherein the lighting-up period includes a plurality of cycles, wherein the cycles serially take place and wherein each of the cycles is corresponded to by a duty ratio, wherein the lighting-up means includes:

given cycle set means for setting a cycle of the pulse signal;

given duty ratio set means for setting a duty ratio of the pulse signal; and given update means, wherein, during the lighting-up period of the LEDs since the lighting-up of the LEDs starts, the given update means outputs, within a cycle set by the given cycle set means, a pulse signal having a time width relative to a corresponding duty ratio set by the given duty ratio set means, and wherein, when a cycle elapses, the given update means instructs the given cycle set means to set a cycle taking place subsequently to the elapsed cycle by increasing the elapsed cycle and instructs the given duty ratio set means to set a duty ratio corresponding to the cycle taking place subsequently to the elapsed cycle by increasing the duty ratio corresponding to the elapsed cycle.

2. The control device of LEDs of claim 1, wherein the pulse output means varies, of the pulse signal, the cycle end the corresponding duty ratio so that a luminance variation characteristic of the LEDs is approximated to a luminance variation characteristic of an electric bulb.

3. A control device of LEDs, comprising:

driving means for driving LEDs; and pulse output means for varying a cycle and a corresponding duty ratio of a pulse signal outputted to the driving means to control the driving means, wherein the pulse output means includes lighting-out means that gradually decreases the cycle and the corresponding duty ratio of the pulse signal during a lighting-out period of the LEDs beginning from a start of a lighting-out of the LEDs.

wherein the lighting-out period includes a plurality of cycles, wherein the cycles serially take place and wherein each of the cycles is corresponded to by a duty ratio, wherein the lighting-out means includes:

certain cycle set means for setting a cycle of the pulse signal;

certain duty ratio set means for setting a duty ratio of the pulse signal; and certain update means, wherein, during the lighting-out period of the LEDs since the lighting-out of the LEDs starts, the certain update means output, within a cycle set by the certain cycle set means, a pulse signal having a time width relative to a corresponding duty ratio set by the certain duty ratio set means, and wherein, when a cycle elapses, the certain update means instructs the certain cycle set means to set a cycle taking place subsequently to the elapsed cycle by decreasing the elapsed cycle and instructs the certain duty ratio set means to set a duty ratio corresponding to the cycle taking place subsequently to the elapsed cycle by decreasing the duty ratio corresponding to the elapsed cycle.

4. A control device of LEDs used in a turning signal lamp of a vehicle, comprising:

driving means that drives the LEDs;

lighting-up means that gradually increases the cycle and the corresponding duty ratio of the pulse signal during a lighting-up period of the LEDs beginning from the start of a lighting-up of the LEDs; and lighting-out means that gradually decreases the cycle and the corresponding duty ratio of the pulse signal during a light-out period of the LEDs beginning from the start of a lighting-out of the LEDs, wherein a lamp signal is generated when a switch of the turning signal lamp is operated, wherein, when the lamp signal indicative of the lighting-up of the LEDs is generated, the lighting-up of the LEDs starts, wherein, when the lamp signal indicative of the lighting-out of the LEDs is generated, the lighting-out of the LEDs starts.

wherein the lighting-up period includes a plurality of cycles, wherein the cycles serially take place and wherein each of the cycles is corresponded to by a duty ratio, wherein the lighting-up means includes:

given cycle set means for setting a cycle of the pulse signal;

given duty ratio set means for setting a duty ratio of the pulse signal; and given update means, wherein, during the lighting-up period of the LEDs since the lighting-up of the LEDs starts, the given update means outputs, within a cycle set by the given cycle set means, a pulse signal having a time width relative to a corresponding duty ratio set by the given duty ratio set means, and wherein, when a cycle elapses, the given update means instructs the given cycle set means to set a cycle taking place subsequently to the elapsed cycle by increasing the elapsed cycle and instructs the given duty ratio set means to set a duty ratio corresponding to the cycle taking place subsequently to the elapsed cycle by increasing the duty ratio corresponding to the elapsed cycle.

5. A control device of LEDs used in a turning signal lamp of a vehicle, comprising:

driving means that drives LEDs;

lighting-up means that gradually increases the cycle and the corresponding duty ratio of the pulse signal during a lighting-up period of the LEDs beginning from the start of a lighting-up of the LEDs; and lighting-out means that gradually decreases the cycle and the corresponding duty ratio of the pulse signal during a light-out period of the LEDs beginning from the start of a lighting-out of the LEDs, wherein a lamp signal is generated when a switch of the turning signal lamp is operated, wherein, when the lamp signal indicative of the lighting-up of the LEDs is generated, the lighting-up of the LEDs starts, wherein, when the lamp signal indicative of the lighting-out of the LEDs is generated, the lighting-out of the LEDs starts, wherein the lighting-out period includes a plurality of cycles, wherein the cycles serially take place and wherein each of the cycles is corresponded to by a duty ratio, wherein the lighting-out means includes:

certain cycle set means for setting a cycle of the pulse signal;

curtain duty ratio set means for setting a duty ratio of the pulse signal; and certain update means, wherein, during the lighting-out period of the LEDs since the lighting-out of the LEDs starts, the certain update means outputs, within a cycle set by the certain cycle set means, a pulse signal having a time width relative to a corresponding duty ratio set by the certain duty ratio set means, and wherein, when a cycle elapses, the certain update means instructs the certain cycle set means to set a cycle taking place subsequently to the elapsed cycle by decreasing the elapsed cycle and instructs the certain duty ratio set means to set a duty ratio corresponding to the cycle taking place subsequently to the elapsed cycle by decreasing the duty ratio corresponding to the elapsed cycle.

* * * * *